US009827644B2

(12) United States Patent
Selles

(10) Patent No.: US 9,827,644 B2
(45) Date of Patent: Nov. 28, 2017

(54) MOWER BLADE SHARPENING DEVICE

(71) Applicant: Mark Selles, Kannapolis, NC (US)

(72) Inventor: Mark Selles, Kannapolis, NC (US)

( * ) Notice: Subject to any disclaimer, the term of this patent is extended or adjusted under 35 U.S.C. 154(b) by 153 days.

(21) Appl. No.: 15/068,316

(22) Filed: Mar. 11, 2016

(65) Prior Publication Data

US 2016/0263720 A1 Sep. 15, 2016

Related U.S. Application Data

(60) Provisional application No. 62/131,292, filed on Mar. 11, 2015.

(51) Int. Cl.
*B24B 3/36* (2006.01)
*B24B 3/42* (2006.01)

(52) U.S. Cl.
CPC ..... *B24B 3/42* (2013.01)

(58) Field of Classification Search
CPC .... B24B 3/42; B24B 3/52; B24B 3/58; B24B 3/36; B24B 3/365; B24B 41/036; B24B 27/0076; B24B 5/42
USPC ..... 451/65, 141, 224, 5, 10, 58, 365, 367, 451/372, 374
See application file for complete search history.

(56) References Cited

U.S. PATENT DOCUMENTS 1,339,511 A * 5/1920 Holm ..... B24B 3/42 451/423
2,164,830 A 7/1939 McGee
2,707,855 A * 5/1955 Miller ..... B24B 27/0076 451/362
2,893,179 A * 7/1959 Sperow ..... B24D 15/06 451/371
3,027,688 A * 4/1962 Zabransky ..... B24B 27/0076 15/21.1
3,061,980 A * 11/1962 Machovec ..... B24B 3/42 451/141
3,100,956 A * 8/1963 Niquet ..... B24B 3/245 451/375
3,124,907 A * 3/1964 Dralle ..... B24B 19/00 125/11.01
3,126,675 A * 3/1964 McEwan ..... B24B 3/42 451/141
3,885,352 A * 5/1975 Juranitch ..... B24B 3/52 451/224
4,471,581 A * 9/1984 Bernard ..... B24B 3/247 451/276

(Continued)

*Primary Examiner* — George Nguyen
(74) *Attorney, Agent, or Firm* — Global Intellectual Property Agency, LLC; Jordan Sworen

(57) ABSTRACT

A sharpening device for sharpening and grinding mower blades. The sharpening device includes a roller table and a plurality of mower blade mounting platforms that slide back and forth atop a base. The mower blade mounting platforms include an electromagnet that secures a mower blade to a support surface and guides for directing the position of the secured mower blade. The sharpening device further includes a plurality of sharpening members, such as grindstones, that engage with the mower blades secured to the mower blade mounting platforms. Each mower blade mounting platform includes adjustment mechanisms that allow a user to alter the lateral position of the blade and the sharpening angle of the blade. A first and second motor causes the mower blade mounting platforms to reciprocate and the sharpening members to rotate.

15 Claims, 6 Drawing Sheets

(56) References Cited

U.S. PATENT DOCUMENTS 4,736,544 A * 4/1988 Greenquist ..... B24B 3/365 451/124
4,787,177 A * 11/1988 Scalia ..... B24B 3/60 269/303
4,936,053 A * 6/1990 Shanelec ..... B24B 3/365 269/45
4,961,288 A * 10/1990 Ketteringham ..... B24B 3/36 451/224
4,984,391 A * 1/1991 Sattler ..... B24B 3/10 451/224
5,218,787 A * 6/1993 Rice ..... B24B 3/365 451/224
5,329,731 A * 7/1994 Wall ..... B24B 3/36 451/233
5,527,208 A * 6/1996 Blake ..... B24B 3/38 269/55
5,938,511 A * 8/1999 Patterson ..... B24B 3/36 451/365
6,123,611 A * 9/2000 Lawrence, Jr. ..... B24B 3/365 451/312
6,475,074 B2 * 11/2002 Blanton ..... B24B 1/00 144/134.1
6,786,806 B2 9/2004 Maus, Jr.
7,029,377 B2 * 4/2006 Bauer ..... B24B 27/0061 451/209
7,329,172 B2 * 2/2008 Dieck ..... B24B 3/365 451/196
7,503,835 B2 3/2009 Cotton
7,918,715 B2 * 4/2011 Clark ..... B24B 3/365 269/59
7,967,666 B1 * 6/2011 Messner ..... B24B 3/365 451/349
2004/0142645 A1 * 7/2004 Maus, Jr. ..... B24B 3/365 451/124
2009/0081931 A1 * 3/2009 Levsen ..... B24B 3/40 451/262
2014/0213160 A1 * 7/2014 Page ..... B24B 27/0015 451/367

* cited by examiner

MOWER BLADE SHARPENING DEVICE

CROSS REFERENCE TO RELATED APPLICATION

This application claims the benefit of U.S. Provisional Application No. 62/131,292 filed on Mar. 11, 2015. The above identified patent application is herein incorporated by reference in its entirety to provide continuity of disclosure.

BACKGROUND OF THE INVENTION

The present invention relates to mower blade sharpeners. More specifically, the present invention relates to a mower blade sharpener apparatus comprising a plurality of reciprocating mounting platforms configured to secure a blade thereto mounted to a roller table that slidably engages with a base to sharpen the secured blade against a sharpening mechanism, such as a grindstone.

Rotary lawnmowers operate by having a blade rotate around its midpoint in a plane substantially parallel to the ground over which the mower runs. The blade typically has two cutting edges, one on each opposed side of the blade's longitudinal axis. One cutting edge extends from one distal end of the blade toward the midpoint of the blade along one edge of the blade, and the other cutting edge extends from the opposite distal end of the blade toward the midpoint of the blade along the opposite edge of the blade from the first cutting edge. The cutting edges must be sharpened periodically to provide desired mowing capabilities, including a clean cut, which may affect grass look and health. Given their high rotational speeds, the blades must also be properly honed and balanced.

Most modern lawnmowers utilize more than one rotating blade to enhance the grass and vegetation cutting ability. Typically, these lawnmower blades are designed to hold a cutting edge to cut through the grass, rather than tear or otherwise remove the grass from the ground. Keeping the lawnmower blades sharpened typically requires a user to hold the blade manually while a lawnmower blade sharpener engages the blade. However, standard lawnmower blade sharpeners, for example, do not allow for the automatic sharpening of a plurality of blades.

In light of the devices disclosed in the prior art, it is submitted that the present invention substantially diverges in design elements from the prior art and consequently it is clear that there is a need in the art for an improvement to existing lawnmower blade sharpeners. In this regard the instant invention substantially fulfills these needs.

SUMMARY OF THE INVENTION

In view of the foregoing disadvantages inherent in the known types of lawnmower blade sharpeners now present in the prior art, the present invention provides a lawnmower blade sharpener wherein the same can be utilized for sharpening multiple blades simultaneously, while independent adjustments may be may to each blade being sharpened.

It is therefore an object of the present invention to provide a new and improved lawnmower blade sharpener that has all of the advantages of the prior art and none of the disadvantages.

The present invention relates to a lawnmower blade sharpener comprising a plurality of blade mounting platforms connected to a roller table, which is in turn slidably connected to a base, wherein blades can be secured thereto via electromagnet and guides.

It is another object of the present invention to provide a lawnmower blade sharpener having a roller table that can slide back and forth along the base, allowing the mower blades supported by the blade mounting platforms to move across corresponding grindstones configured to sharpen multiple mower blades simultaneously.

It is therefore an object of the present invention to provide a roller table that is actuated in an reciprocating motion via a motor and rests atop a movable base, wherein the motors are controlled via control box affixed to the base having a control timer and actuatable switches.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
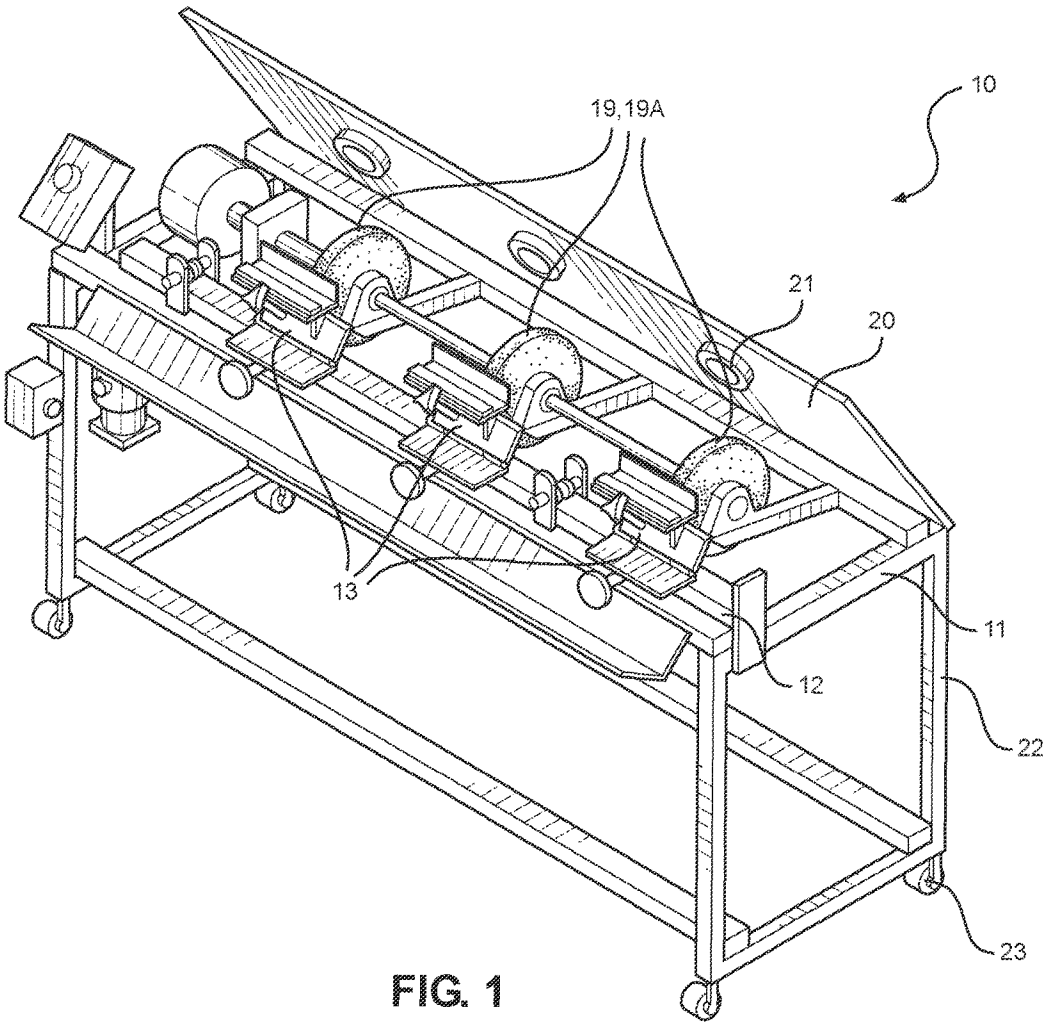
FIG. 1 shows a perspective view of one embodiment of the present invention.

Reference is made herein to the attached drawings. Like reference numerals are used throughout the drawings to depict like or similar elements of the mower blade sharpener. For the purposes of presenting a brief and clear description of the present invention, the preferred embodiment will be discussed as used for sharpening a plurality of mower blades simultaneously.

The figures are intended for representative purposes only and should not be considered to be limiting in any respect.

Referring now to FIG. 1, there is a shown perspective view of one embodiment of the present invention. The present invention provides a sharpening device 10 that can be utilized for sharpening multiple blades simultaneously, while independent adjustments may be made to each blade being sharpened. The sharpening device 10 comprises a plurality of mower blade mounting platforms 13 connected to a roller table 12, which is in turn slidably connected to a base 11. The mower blade mounting platforms 13 are configured to secure a blade thereto and position the blade for engagement with a sharpening member 19.

In the shown embodiment, the sharpening device 10 includes three mower blade mounting platforms 13 and corresponding sharpening members 19. Each mower blade mounting platforms 13 is affixed to the roller table 12 at intervals that allow coupled blades to engage with the sharpening members 19. Each sharpening members 19 is affixed to the base 11 at intervals and is positioned to allow engagement with a blade secured to the mower blade mounting platforms 13. In one embodiment, each mower blade mounting platforms 13 and sharpening members 19 are spaced at an interval of approximately three feet. However, in alternative embodiments, the interval between adjacent mower blade mounting platforms 13 and adjacent sharpening members 19 may be various distances.

In the shown embodiments, the base is constructed from tubular members and further comprises one or more legs 22 configured to engage the floor and support the base 10 and roller table 12. The legs 22 each include a wheel 23 or caster that provides for rolling engagement with the floor or other planar surface. This allows the present invention to be selectively moved and positioned as desired. An overhead cover 20 is affixed to the base 11, wherein the cover 20 extends upward and is positioned over the mower blade mounting platforms 13. The cover 20 further comprises one or more lights 21, wherein the lights 21 are directed towards the mower blade mounting platforms. The lights 21 are operably connected to an electrical power source.

Figure 2:
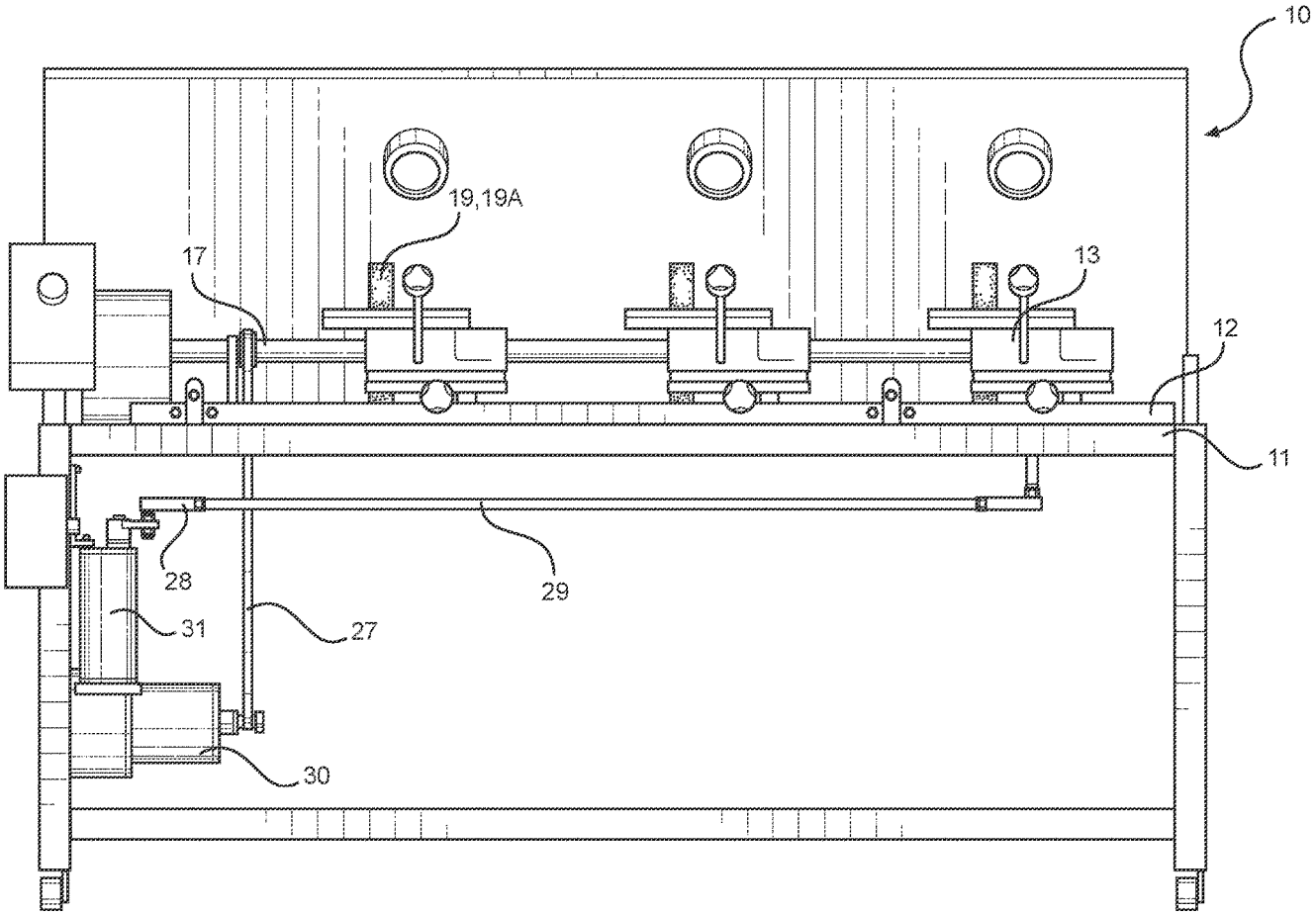
FIG. 2 shows a front view of one embodiment of the present invention.

Referring now to FIG. 2, there is a shown front view of one embodiment of the present invention. The sharpening device 10 further comprises one or more motors 30, 31, wherein a first motor 30 is operably connected to the sharpening members 19 and a second motor 31 operably connected to the roller table 12. In the shown embodiments, the first motor 30 is operably connected to a pulley 27 that transfers the rotational energy to a drive shaft 17, which in turn is operably connected to the sharpening members 19. In the illustrated embodiments, the sharpening members 19 are disk grindstone 19A. However, in alternative embodiments, the sharpening members 19 may be belts and the like. In this embodiment, the belt may be an endless belt mounted to several rollers arranged traversely to the sharpening direction and powered by a rotary power source.

In the illustrated embodiments, the grindstones 19A are in linear arrangement along a drive shaft 17, wherein the grindstones 19A are configured to rotate about a central axis that is in a general perpendicular plane to the drive shaft 17 and linear arrangement of grindstones 19A. A circumferential edge of the grindstones 19A are configured to engage and sharpen mower blades secured to the mower blade mounting platforms 13. In some embodiment, the grindstones 19A are approximately one foot in radius, and constructed from a hard rock, such as granite. However, in alternative embodiments the grindstones 19A will have varying dimensions and be constructed from any suitable material.

The second motor 31 operably connected to the roller table 12 via an arm 28 and rod 29. In the shown embodiments, the second motor 31 is a variable speed gear motor pivotally connected to an arm 28 that is in turn pivotally attached to a rod 29, wherein the pivotal connection to the arm 28 is configured to alter rotational movement to linear movement. At the opposing end of the rod 29, the rod 29 is connected the roller table 12, where actuation of the second motor 31 causes the roller table 12 to slide back and forth along the base 11. Thus, causing the mower blade mounting platforms 13 to move across the sharpening members 19. The movement of the roller table 12 across the base 11 is in a reciprocating or oscillating motion. This movement allows the sharpening members 19 to engage with the cutting edges of mower blades disposed on each opposed side of the blade's longitudinal axis.

In one embodiment of the present invention, the first and second motor 30, 31 utilize the same power source. In a second embodiment, the first and second motor 30, 31 utilize different power sources. For example, a 120V AC power source may be in electrical communication with the first motor 30 with a separate 12V DC power source in electrical communication with the second motor 31.

Figure 3:
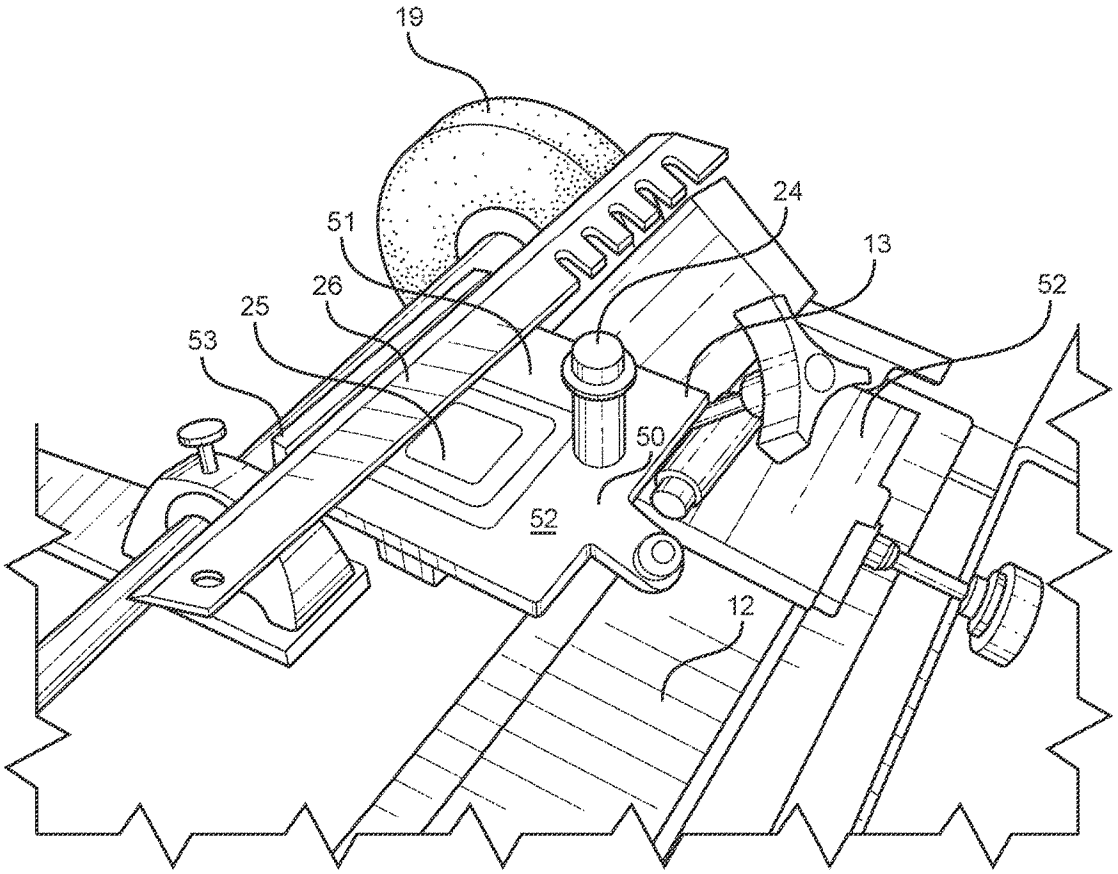
FIG. 3 shows a close-up view of one embodiment of the mower blade mounting platform of the present invention.

Referring now to FIG. 3, there is a close-up view of one embodiment of the mower blade mounting platform of the present invention. Each mower blade mounting platform 13 comprises a first upper assembly 50 connected to a second lower assembly 51. The first assembly 50 further comprises a planar support surface 52 upon which mower blades 26 rest, an electromagnet 25 in electrical communication with a power source, and one or more guides 24 for directing the position of the secured mower blade 26.

In the shown embodiment, the planar support surface 52 is perpendicularly affixed to a back plate 53 that is configured to position the secured mower blade 26 flush thereagainst. The back plate 53 aligns the secured mower blade 26 relative to the sharpening members 19. The electromagnet 25 is positioned towards the center of the planar support surface 52 and is configured to magnetically couple the mower blade 26 to the planar support surface 52. In the shown embodiment, the mower blade 26 extend past the end of the first assembly 51 and positioned over second assembly 52. The magnetic coupling strength of the electromagnet 25 may be sufficient to allow engagement between the mower blade 26 and sharpening members 19 without the magnetic couple to become uncoupled.

The guide 24 of the first assembly of the mower blade mounting platform 13 is configured to adjust the lateral movement of the secured mower blade 26 and to secure mower blades 26 of varying width to the mower blade mounting platform 13. In the shown embodiment, the guide 24 is an upstanding cylinder with tightening arm (not shown) that prevents the mower blade 26 from moving away from the sharpening members 19 when lateral force is applied to engage the mower blade 26 against the sharpening members 19.

Furthermore, the mower blade mounting platforms 13 are adjustably connected to the roller table 12, which allows for the position and angle of a mower blade 24 secured to the mower blade mounting platform 13 to be adjusted relative to the sharpening members 19. Each of the mower blade mounting platform 13 are independently adjustable.

Figure 4:
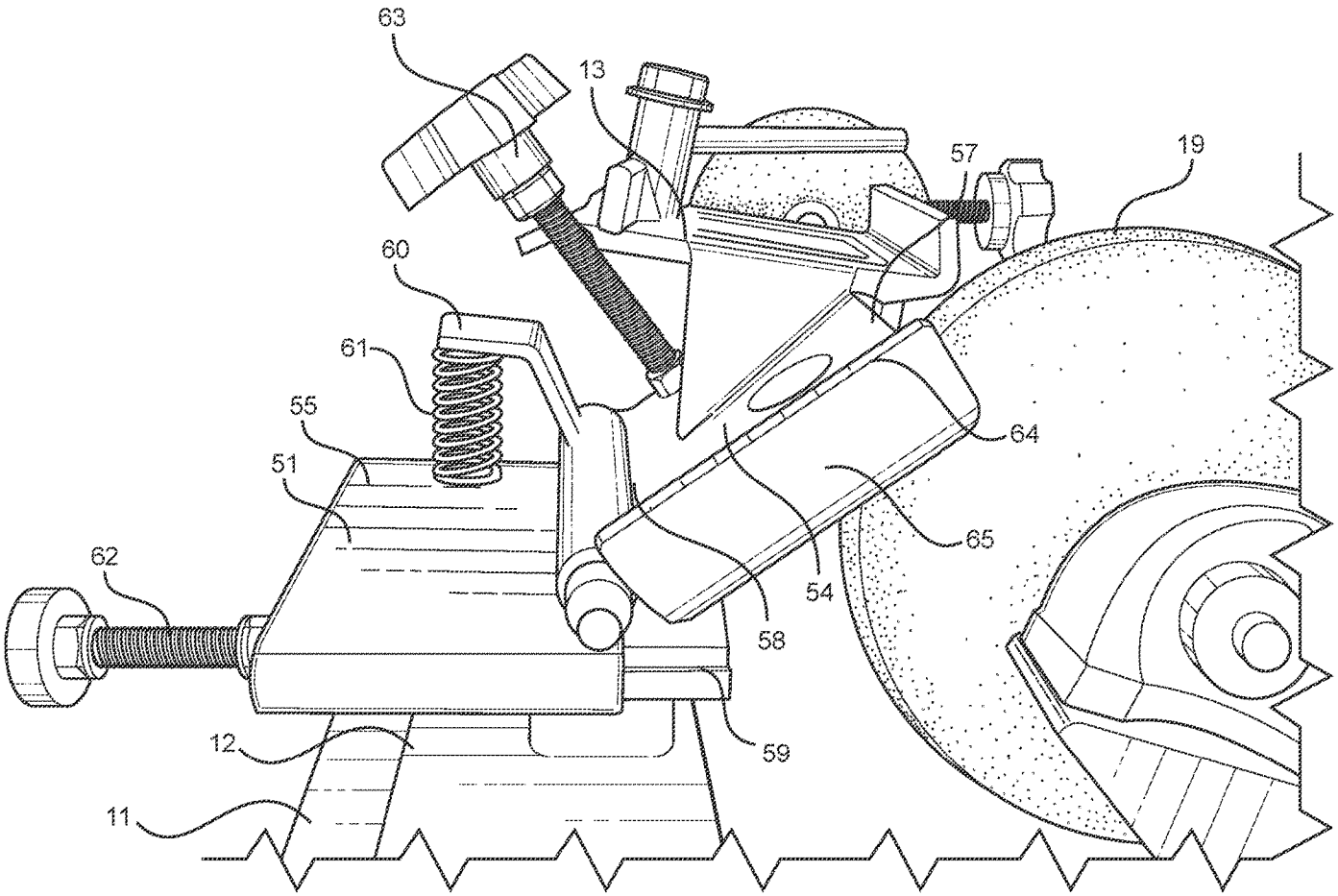
FIG. 4 shows a side view of one embodiment of the mower blade mounting platform of the present invention.

Referring now to FIG. 4, there is a side view of one embodiment of the mower blade mounting platform of the present invention. The second lower assembly 51 of the mower blade mounting platform 13 comprises a first plate 54 pivotally affixed to a second plate 55. The first plate 54 further comprises a first end 57 and a second end 58, wherein the first end 57 is configured to assist with the support of the mower blade that extends from the first assembly and the second end 58 is affixed to the second plate 55 via hinge 56. The hinge 56 allows for pivotal rotation of the first plate 54 relative to the second plate 55. This allows for angle adjustment of the mower blade (not shown) relative to the sharpening member 19. The first plate 54 further comprises a first side 64 and an opposing second side, wherein said first side 64 comprises an upstanding end plate 65. The upstanding end plate 65 is configured to secure the mower blade to said surface of the first end 57, and prevent the secured blade from unwanted movement during the sharpening and engagement with the sharpening members 19.

The second lower assembly 51 further comprises a blade angle adjustment mechanism 63 that is configured to adjust the angle between the mower blade and sharpening member 19. In the shown embodiment, the blade angle adjustment mechanism 63 is a threaded post that is perpendicular to and threadably connected to the first plate 54, wherein the blade angle adjustment mechanism 63 runs through the first plate 54 and is threadably connected to a fixed object, such as the base (not shown). The blade angle adjustment mechanism 63 may be rotated in a first direction to cause the first plate 54 to move towards the sharpening member 19, and in an opposing second direction to cause the first plate 54 to move away from the sharpening member 19. The movement of the first plate 54 alters the angle at which the mower blade engages the sharpening member 19. Since mower blades are manufactured and designed to have certain angles and blade angles change over time, the hinge 56 enables users to select and adjust the angle of the mower blade engages the sharpening member 19. In addition, the blade angle adjustment mechanism 63 acts as a preset stop that is activated when the grindstones 19A are spinning without removing any blade material, indicating that the edge of the blade being sharpened as reached the desired sharpness.

The first plate 54 further comprises a finger 60 that extends away from the second end 58 and is affixed to a spring 61 at the distal end of the finger 60. The spring 61 has a first end affixed to the finger 60 and a second end affixed to the second plate 55. In the illustrated embodiment, the second plate 55 and an extension plate 59 are plate members comprising a rectangular cross-section, however in alternative embodiments, they may comprise any suitable cross-sectional shape.

The spring 61 controls the amount of force between the sharpening members 19 and mower blade by modulating between compression and expansion. As the mower blade engages the sharpening members 19, a lateral force away from the sharpening members 19 is applied to the first plate 57 of the second assembly 51. This causes the first plate 57 to rotate about the hinge 56 towards the second plate. However, the rotation causes the finger 60 to compress the spring 61 against the second plate. This produces a dampening effect that regulates the amount of force and position between the mower blade and the sharpening members 19. Overall, the spring 61 prevents the sharpening members 19 from applying too much force to the mower blade.

The second plate 55 of the second assembly 51 of the mower blade mounting platform 13 is comprises an extension plate 59 that is affixed to the roller table 12. The extension plate 59 is aligned with the second plate 55 and a lateral adjustment mechanism 62 enables the distance between the mower blade mounting platform 13 and the sharpening member 19 to be selectively adjusted. In the shown embodiment, the second plate 55 is adjustably secured to extension plate 59 so as to allow the mower blade mounting platform 13 to move towards and away from the sharpening member 19. This telescopic arrangement of the second plate 55 and extension plate 59 provides for lateral adjustment of each mower blade mounting platform 13, independent of each other. Thus, the sharpening device 10 is configured to sharpen multiple differing mower blades of various shapes and sizes at each mower blade mounting platform 13.

In the shown embodiment, the lateral adjustment mechanism 62 is a threaded post that is aligned with and threadably connected to both the second plate 55 and extension plate 59. The threaded post may be rotated in a first direction to cause the second plate 55 to move towards the extension plate 59, and in an opposing second direction to cause the second plate 55 to move away from the extension plate 59.

Figure 5:
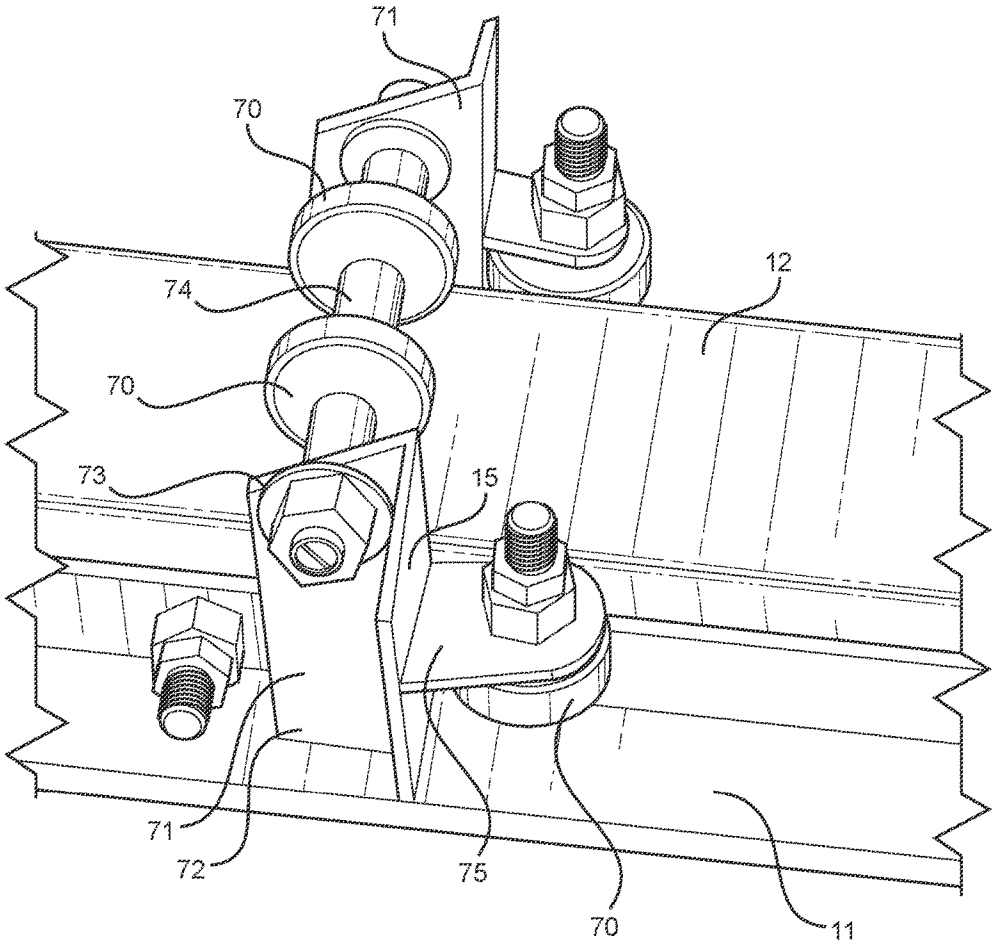
FIG. 5 shows a close-up view of one embodiment of the roller table and bearing assembly of the present invention.

Referring now to FIG. 5, there is a close-up view of one embodiment of the roller table and bearing assembly of the present invention. In the shown embodiment, the bearing assembly 15 provides sliding engagement between the base 11 and the roller table 12, via a plurality of wheels 70 that are freely rotatable. The bearing assembly 15 provides lateral and top movement control of the roller table 12 and connected mower blade mounting platforms 13.

In the illustrative embodiment, the bearing assembly 15 comprises a pair of support brackets 71 disposed on opposing sides of the roller table 12. The support brackets 71 have a first end 72 and a second end 73, wherein the first end 72 is affixed to the base 11, and the second end 73 includes a rotatable shaft 74 that interconnects the second ends of the support brackets 71. The shaft 74 is configured to receive a plurality of wheels 70, wherein the wheels 70 are free to rotate and contact the upper surface of the roller table 12. The support brackets further include a generally perpendicular plate 75 supporting one or more wheels 70 configured to engage the sides of the roller table 12. In an alternative embodiment, the bearing assembly 15 further includes a plurality of wheels 70 disposed on the underside of the roller table 12 that supports and is in sliding engagement with the base 11.

Figure 6:
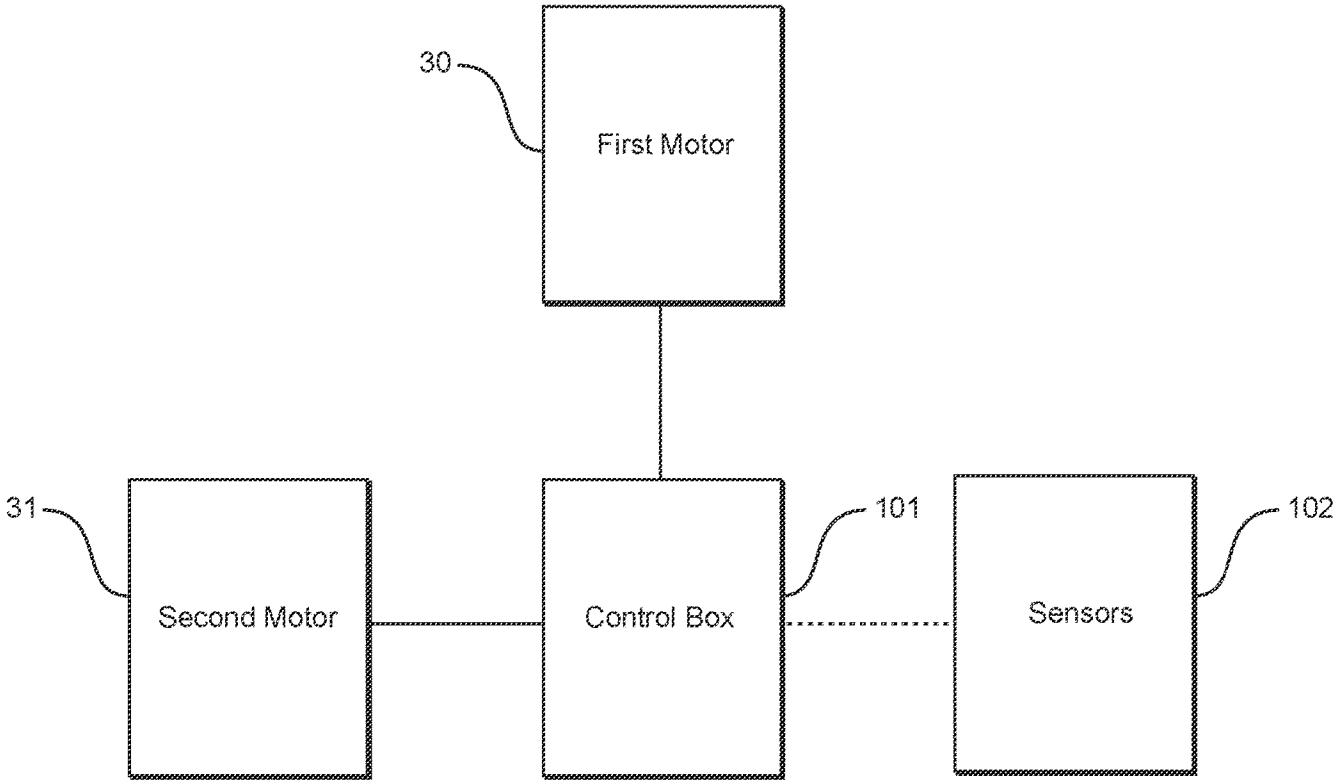
FIG. 6 shows a schematic diagram of the components of the present invention.

Referring now to FIG. 6, there is shown a block diagram of one embodiment of the present invention. The sharpening device comprises a control box 101 operably connected to the first and second motor 30, 31, wherein the control box 101 includes at least one actuatable button that activates and deactivates the sharpening device 10. In the shown embodiment, the control box 101 comprises a computer with a processor configured to sharpen the blades until each are sufficiently sharpened at which point the computer stops the sharpening.

The computer includes logic stored on a computer-readably medium that, when executed by the processor of the present invention, causes the sharpening device to perform a number of steps including causing the first motor 30 to rotate the sharpening member 19 and the second motor 31 to reciprocate the mower blade mounting platforms 13. The sharpening device 10 also comprises a plurality of sensors 102 configured to monitor the sharpness of the mower blade throughout the sharpening process. The sensors may be optical sensors or other sensors disposed on the overhead cover, the base, or the like, wherein data related to the sharpness of the mower blade is communicated, wired or wirelessly, to the control box 101. The control box 101 then determines the duration of the sharpening required, based on the present blade sharpness and a preset sharpness selection.

An alternative embodiment of the present invention comprises a control box 101 which provides the user with a means to determine the duration of the sharpening via a control timer, the speed at which the mower blade mounting platforms 13 reciprocate, the rest positions for the mower blade mounting platforms 13 when the machine is deactivated. The control timer ensures that the sharpening device 10 does not run needlessly when a user is not actively watching the present invention.

In one use of one embodiment of the present invention, the sharpening device is utilized by placing mower blades on the mower blade mounting platforms then adjusting the position of the mower blade mounting platforms via the blade angle adjustment mechanism and the lateral adjustment mechanism so that the edge of the mower blade to be sharpened rests just against the grindstone. Once secured and positioned, the user then activates the present invention. When the present invention is powered on, the electromagnet magnetizes and secured the mower blade in place. Then the second motor reciprocates the mower blades across the rotating grindstones, which is driven by the first motor, thereby sharpening the mower blade. The user makes adjustments while the first side of the blades are being sharpened to ensure the first side is sharpened to the desired degree. Once the mower blade has been sufficiently sharpened, the user can power the system down, flip the mower blades such that the sharpening process proceeds with the opposing unsharpened mower blade edge.

I claim:

1. A sharpening device comprising:

a roller table slidably engaged with a base via one or more bearing assemblies;

a plurality of mower blade mounting platforms mounted to said roller table at a fixed interval;

wherein said mower blade mounting platforms comprises a first assembly have a support surface upon which said support surface is adapted to support a mower blade;

a plurality of sharpening members configured for complementary use with said plurality of mower blade mounting platforms;

wherein said sharpening members are configured to engage and sharpen said mower blades.

2. The sharpening device of claim 1, further comprising:

wherein said sharpening members are disk grindstones operably connected via a drive shaft to a first motor configured to rotate said disk grindstones.

3. The sharpening device of claim 2, wherein:

said grindstones are configured to rotate about a central axis comprising a circumferential edge configured to engage and sharpen mower blades.

4. The sharpening device of claim 1, further comprising:

a second motor operably connected to said roller table, wherein the second motor is configured to oscillate and linearly adjust the position of said roller table.

5. The sharpening device of claim 4, wherein:

said second motor is a variable speed gear motor pivotally connected to an arm that is attached to the roller table via a rod, wherein said pivotal connect to said arm is configured to alter rotational movement to linear movement.

6. The sharpening device of claim 1, wherein:

said first assembly of the mower blade mounting platforms further comprises an electromagnet configured to electromagnetically secure the mower blade to the support surface of the first assembly of the mower blade mounting platforms.

7. The sharpening device of claim 1, wherein:

said mower blade mounting platform further comprises an guide configured to adjustable the lateral movement of mower blades and to secure mower blades of varying width to the mower blade mounting platform.

8. The sharpening device of claim 1, wherein:

said first assembly of the mower blade mounting platforms is connected to a second assembly having a first plate hingedly affixed to a second plate;

wherein said first plate comprises a first end and an opposing second end;

wherein said first end of said first plate includes a surface for supporting said mower blade.

9. The sharpening device of claim 8, wherein:

said second plate of said second assembly is adjustably connected to an extension member;

wherein a lateral adjustment mechanism is configured to adjust the lateral position of the mower blade mounting platforms relative to the sharpening mechanisms.

10. The sharpening device of claim 8, wherein:

said first plate of said second assembly includes a first side and an opposing second side, wherein said first side comprises an upstanding end plate configured to secure the mower blade to said surface of said first end.

11. The sharpening device of claim 1, further comprising:

an overhead cover affixed to the base, wherein said cover extends upward and is positioned over said plurality of mower blade mounting platforms.

12. The sharpening device of claim 11, wherein:

said cover further comprises one or more lights directed towards the mower blade mounting platforms.

13. The sharpening device of claim 1, further comprising:

a control box operably connected to said first motor and second motor having a control timer;

wherein said control timer determines a duration of the engagement between said mower blade and sharpening members.

14. The sharpening device of claim 1, further comprising:

a control box operably connected to a first motor and a second motor;

wherein the control box further comprises at least one actuatable button that activates and deactivates said first and second motor.

15. The sharpening device of claim 13, further comprising:

one or more sensors operably connected to said control box;

wherein said sensors are configured to monitor the mower blade sharpness.

* * * * *